United States Patent [19]

Blaseck

[11] Patent Number: 4,497,776

[45] Date of Patent: Feb. 5, 1985

[54] ARRANGEMENT FOR INTERCONNECTING CONDUITS

[75] Inventor: Klaus Blaseck, Burgdorf, Fed. Rep. of Germany

[73] Assignee: Deutsche Gesellschaft für Wiederaufarbeitung von Kernbrennstoffen mbH, Hanover, Fed. Rep. of Germany

[21] Appl. No.: 531,179

[22] Filed: Sep. 9, 1983

[30] Foreign Application Priority Data

Sep. 17, 1982 [DE] Fed. Rep. of Germany ..... 3234513

[51] Int. Cl.[3] ..... G21F 9/14

[52] U.S. Cl. ..... 422/159; 422/903

[58] Field of Search ..... 419/56, 126; 285/17, 285/121, 131; 248/188.2; 422/159, 903; 252/301.1 W

[56] References Cited

U.S. PATENT DOCUMENTS 4,055,508 10/1977 Yoli et al. ..... 422/159 X 4,439,318 3/1984 Hayashi et al. ..... 422/159 X

FOREIGN PATENT DOCUMENTS 1030679 5/1966 United Kingdom ..... 415/56

*Primary Examiner*—Thomas Wyse

*Attorney, Agent, or Firm*—Walter Ottesen

[57] ABSTRACT

A large-area cell for reprocessing irradiated nuclear reactor fuel elements contains racks in which process components and connecting conduits for the latter are arranged. The arrangement of the invention connects the conduits of a rack with a plurality of supply conduits outside of the cell which have end portions that penetrate the interior wall of the cell. When the racks are assembled and disassembled, the conduits leading to the process components contained in the rack have to be disconnected from the supply conduits. The conduits should be connected and disconnected rapidly and surely by means of remotely-controlled manipulating apparatus. For this purpose, the arrangement of the invention for interconnecting conduits includes two terminal blocks each having a plurality of passages formed therein. The two terminal blocks are connected to each other by conduit segments which communicate with corresponding ones of the passages in the blocks. The free ends of the passages in the blocks terminate in a common surface thereof and define a predetermined pattern which corresponds to the pattern of the conduit end portions in the rack on the one hand and, to the conduit end portions at the cell wall on the other hand. The two terminal blocks and the conduit segments conjointly define a portable unit which is removable from and returnable to a rest position whereat the unit connects the wall conduit end portions with respective ones of the rack conduit end portions. The free ends of the terminal blocks, the conduit end portions at the rack, and the conduit end portions at the wall are aligned by centering arrangements.

7 Claims, 6 Drawing Figures

FIG. 4
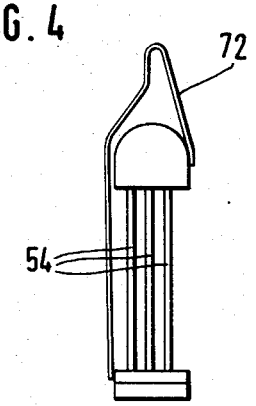
FIG. 5
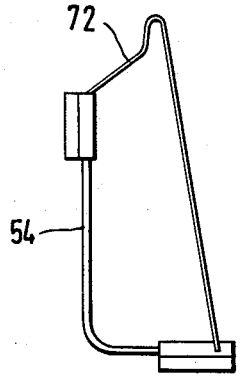
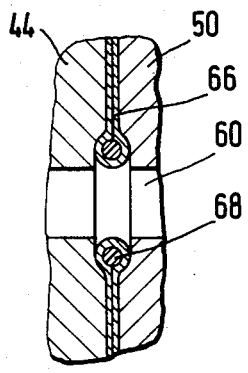
FIG. 6

ARRANGEMENT FOR INTERCONNECTING CONDUITS

FIELD OF THE INVENTION

The invention relates to an arrangement for interconnecting conduits in a processing cell such as a large-area cell or the like for reprocessing irradiated nuclear reactor fuel elements. A large-area cell contains racks in which process components and connecting conduits for the latter are arranged. The arrangement of the invention connects the conduits of a rack with a plurality of conduits outside of the cell which have end portions that penetrate the interior wall of the cell.

BACKGROUND OF THE INVENTION

Facilities for reprocessing irradiated nuclear fuels are provided with so-called hot cells for housing the process equipment used. In these radiation-shielded large-area cells, the process equipment is accommodated in frames or scaffoldlike structures also known as racks.

The maintenance work within the large-area cells subjected to radiation must be effected without the necessity of having operating personnel enter the cells. The maintenance work is therefore performed by using remotely-controlled manipulating apparatus. In this connection, it is preferable that the racks within which the process equipment is contained be lined up in modular configuration along the longitudinal walls of the hot cell. This makes it possible to completely exchange a rack.

With such an exchange, all tubular conduits which connect two completely loaded racks to each other must be disconnected by remotely-controlled manipulating apparatus and, after the new rack is put in place, the tubular conduits must again be connected with each other. On the other hand, the conduits from the outside which serve only to supply the respective process components of a rack must also be disconnected and connected by remotely-controlled manipulating apparatus. The end portions of the conduits of the process components in a rack are preferably arranged so that they lead to a connecting plate at the top of the rack. The conduit connection between the rack and the conduits extending into the cell from the outside therefore lies at one location.

SUMMARY OF THE INVENTION

It is an object of the invention to provide an arrangement for interconnecting a plurality of conduits brought into the cell from the outside with the end portions of the conduits of the process components by means of which the plurality of conduits from the outside can be quickly and surely connected to and disconnected from the conduit end portions of the process components.

The arrangement of the invention for connecting conduits is applicable, for example, in a processing cell such as a large-area cell or the like for reprocessing irradiated nuclear reactor fuel elements. The large-area cell has an interior wall which is penetrated from the outside by the end portions of a plurality of conduits and the cell contains a rack in which process components and connecting conduits for the latter are arranged.

The conduit interconnecting arrangement of the invention interconnects the connecting conduits of the rack with respective ones of the conduit end portions penetrating the interior wall of the cell and includes:

two terminal blocks each having a plurality of passages formed therein and a plurality of conduit segments tightly connecting the blocks with each other so as to communicate with corresponding ones of the passages formed in each of the blocks. The plurality of conduits outside of the large-area cell are arranged so as to cause the respective conduit end portions thereof penetrating the cell wall to define a first predetermined pattern and the free ends of the passages in one of the blocks terminate in a pattern corresponding to the first pattern. First interface means joins the free ends of the one block with corresponding ones of the wall conduit end portions. The connecting conduits of the rack are arranged to cause the respective conduit end portions thereof to define a second predetermined pattern and the free ends of the passages of the other one of the blocks terminate in a pattern corresponding to the second pattern. Second interface means joins the free ends of the other block with corresponding ones of the rack conduit end portions. The two terminal blocks and the conduit segments conjointly define a portable unit removable from and returnable to a rest position whereat the portable unit connects the wall conduit end portions with respective ones of the rack conduit end portions. First centering means centers the one block with respect to the wall conduit end portions so as to bring the passages of the one block into alignment with corresponding ones of the wall conduit end portions when the unit is placed in the rest position. Second centering means centers the other one of the blocks with respect to the rack conduit end portions so as to bring the free ends of the passages of the other block into alignment with corresponding ones of the rack conduit end portions when the portable unit is placed in the rest position.

According to a further feature of the invention, a first securing means such as a threaded bolt secures the one terminal block tightly against the wall conduit end portions. The other terminal block is tightly secured against the rack conduit end portions with second securing means which also can be a threaded bolt.

With the arrangement of the invention, a plurality of conduit end portions extending into the cell from the outside can be simultaneously connected to or disconnected from a plurality of conduit end portions of a rack containing process components. The arrangement of the invention is especially suited for use with remotely-controlled manipulating apparatus. The arrangement of the invention can be handled from a remote location with the remotely-controlled manipulating apparatus because the means for securing the terminal blocks in place is easily accessible from the interior of the cell when compared with conventional arrangements for connecting flanged conduits.

The first interface means includes: a flat surface formed on the one terminal block at which the free ends of the passages formed therein terminate; and, a wall connecting plate mounted on the wall of the cell and having apertures formed therein for accommodating respective ones of the wall conduit end portions in a close cluster. The apertures are arranged in the first predetermined pattern at the flat surface of the plate facing away from the wall. The flat surface of the one terminal block and the flat surface of the wall connecting plate are tightly held together by the first securing means when the portable unit is in its rest position.

On the other hand, the second interface means includes: a flat surface formed on the other terminal block at which the free ends of the passages formed therein terminate; and, a rack connecting plate mounted on the rack and having apertures formed therein for accommodating respective ones of the rack conduit end portions. The apertures of the rack connecting plate are arranged in the second predetermined pattern at the flat surface of the plate facing away from the rack. The flat surface of the other terminal block and the flat surface of the rack connecting plate are tightly held together by the second securing means when the portable unit is in its rest position.

Preferably, the rack connecting plate is mounted on top of the rack so as to define a plane extending perpendicularly to the plane of the wall connecting plate. The connecting segments are parallel to each other and curved at an angle of ninety degrees so that the segments interconnect the one terminal block with the other terminal block. With this feature of the invention, a conduit interconnecting arrangement is provided which spans the region to be bridged in a space-saving manner. Furthermore, unobstructed access is provided to the securing means which hold the portable unit in place.

According to another feature of the invention, the first centering means includes a pair of projecting metal guides extending outwardly from the inside wall of the cell at selected locations on the periphery of the wall connecting plate to guide the one terminal block into aligned engaging contact with the wall connecting plate when the portable unit made up of the two terminal blocks and the connecting segments is placed in the rest position. The second centering means includes a set of projecting metal guides extending outwardly from the top of the rack at selected locations on the periphery of the rack connecting plate for guiding the other block into aligned engaging contact with the rack connecting plate when the portable unit is placed in its rest position.

A simplified assembly of the conduit interconnecting arrangement is obtained with the above-described centering means. The metal guides at the connecting plates ensure a definitive centering of the terminal blocks and thereby an alignment of the passages formed in the blocks with corresponding ones of the conduit end portions.

With the invention, it is possible to connect and disconnect a plurality of conduits. After disconnecting the conduits by removing the portable unit, a clear space is provided between the wall conduit end portions and the rack conduit end portions. This is a substantial advantage over the conventional arrangement wherein conduit flanges are utilized so that the clear space achieved with the invention was not previously available. This clear space permits adequate movement during the disassembly of the entire rack.

BRIEF DESCRIPTION OF THE DRAWING

The invention will now be described with reference to the drawing wherein:

FIG. 4 is a front view schematic of the conduit interconnecting arrangement of the invention showing the transporting bracket thereof;

FIG. 5 is a side view schematic of the conduit interconnecting arrangement of FIG. 4; and, FIG. 6 is a breakout view, in section, showing the sealing plate disposed between a terminal block and a connecting plate.

DESCRIPTION OF THE PREFERRED EMBODIMENTS OF THE INVENTION

Figure 1:
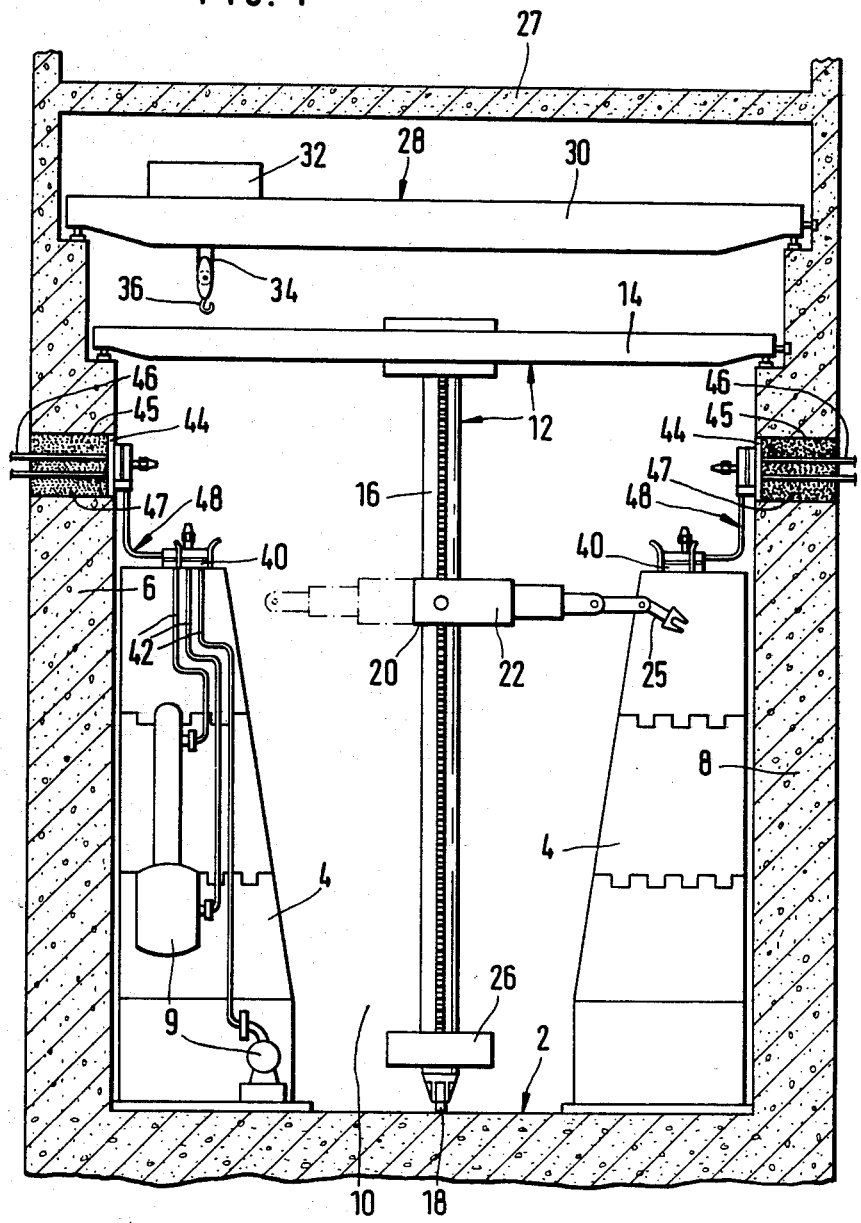
FIG. 1 is an elevation view of a large-area cell containing racks disposed along respective side walls which are fitted with the arrangement according to the invention for interconnecting conduits.

The large-area cell shown in FIG. 1 contains a plurality of frames or so-called racks 4 which are disposed along mutually adjacent walls 6 and 8. The racks have an indexed configuration and contain process components 9. The mutually adjacent rows of racks conjointly define a centrally disposed passageway 10 along which a manipulator carrier system 12 can move. The manipulator carrier system includes an overhead bridge beam 14 which is mounted on rails in the side walls 6 and 8 so as to be movable in a horizontal plane. A vertical guide column 16 is suspended from the bridge beam 14 at its mid region and has a roller arrangement 18 in contact with the passageway 10 at its lower end.

The guide column 16 is rotatable about its longitudinal axis and has a support 20 movably mounted thereon for movement up and down the column. A telescopically-extendible arm 22 is carried by the support 20. The arm 22 is adapted to provide manipulators, tools or other remotely-controlled apparatus at its outer end. In FIG. 1, a manipulator in the form of a master-slave device is provided which includes a slave arm 25. The guide column 16 carries a tool table 26 at its lower end.

A remotely-controlled bridge crane 28 is arranged just underneath the ceiling wall 27 and above the bridge beam 14 of the manipulator carrier system 12. The bridge crane 28 includes a trolley 32 movable in a direction transverse to the movement of the bridge crane. The trolley 32 carries a movable crane hook 36 on a cable 34. The crane hook 36 is movable in the vertical direction.

Each of the racks 4 is provided with a rack connecting plate 40 at its top end for receiving the conduit end portions of respective conduits leading to the process components 9. Above the racks 4 on the cell walls 6 and 8 there are provided wall connecting plates 44 for receiving the conduit end portions of respective sets of conduits 46 which are lead from outside the cell through a wall plug 45. Each of the wall connecting plates 44 is secured at the end face of a corresponding wall plug 45 filled with lead granulate 47.

Figure 2:
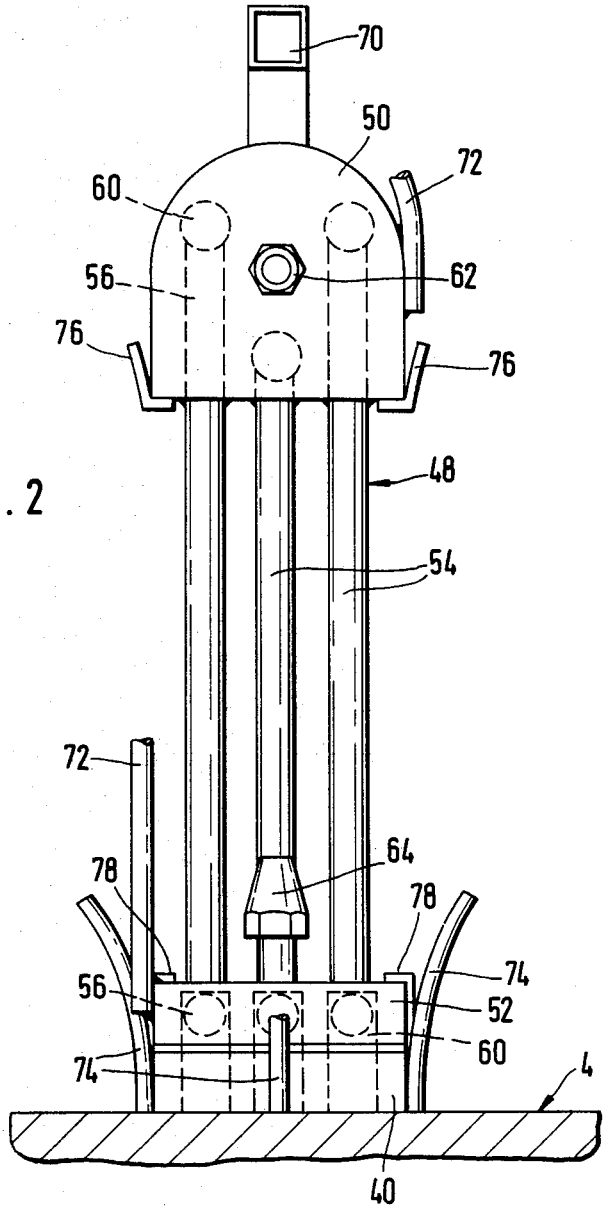
FIG. 2 is a front elevation view of the conduit interconnecting arrangement of the invention.
Figure 3:
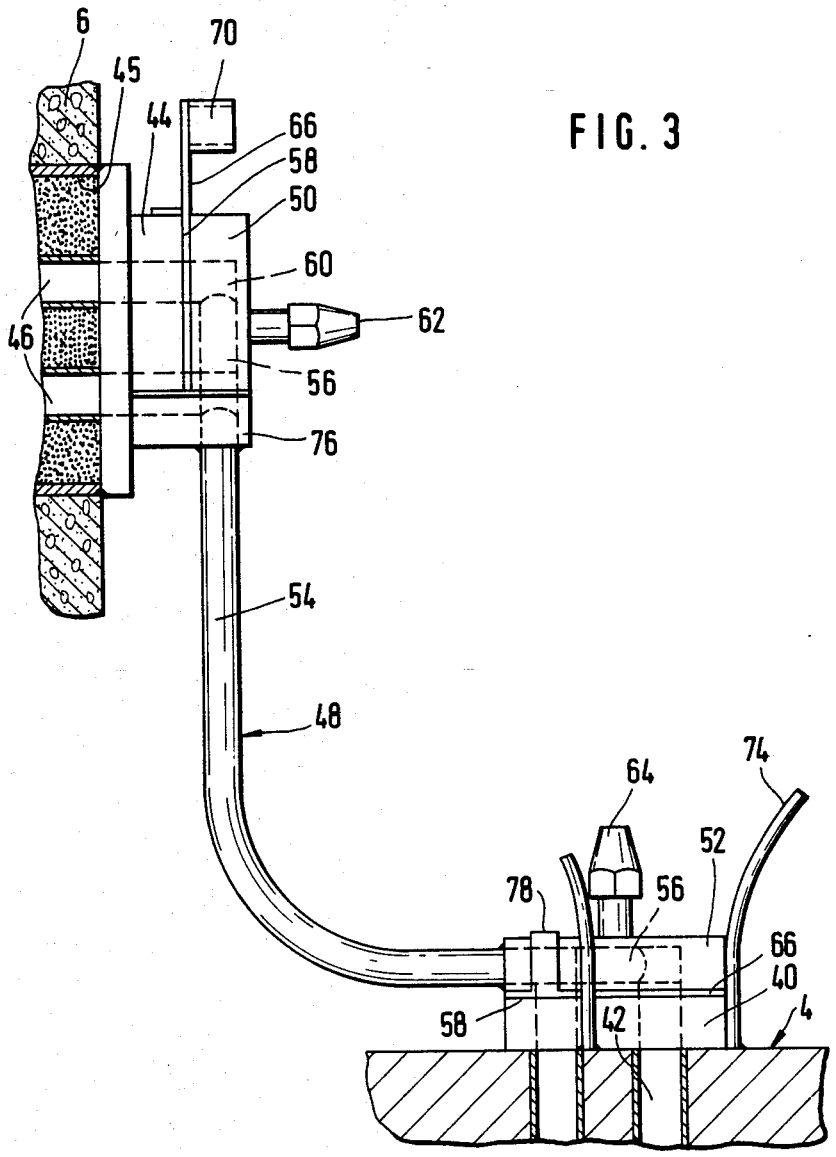
FIG. 3 is a side elevation view of the conduit interconnecting arrangement shown in FIG. 2.

For each rack 4, the connecting plates 40 and 44 are connected to each other by means of a portable conduit connecting unit 48. The portable unit 48 is shown in FIGS. 2 and 3 and includes two terminal blocks 50 and 52 which are connected to each other by three mutually parallel conduits 54. The conduits 54 are curved to define an angle of ninety degrees and the terminal blocks 50,52 are in planes that are perpendicular to each other. The conduits 54 communicate with passages 56,60 formed in the terminal blocks 50,52. The first segments 56 of the passages in each of the blocks are arranged so as to be in alignment with respective conduit segments 54. The remaining segments 60 of each of the passages are bores extending perpendicularly to the first segments, respectively. The bores 60 terminate at a common surface 58. The bores 60 communicate with respective sets of conduit end portions 42,46 in the connecting plates 40 and 44, respectively. The pattern of the bores 60 of the terminal blocks 50,52 correspond to the pattern of the conduit end portions 40,44 which are to be interconnected.

The terminal blocks 50,52 are tightened against connecting plates 40,44 by means of centrally disposed threaded bolts 62,64. Between terminal block 50 and connecting plate 44 and between terminal block 52 and connecting plate 40 there are provided respective sealing plates 66 having sealing rings 68 for sealing the connecting locations between the terminal blocks 50,52 and corresponding ones of the connecting plates 40,44. The sealing plates 66 are made of a deformable metal plate which encloses the elastic sealing rings 68 as shown in FIG. 6. At the upper side of the sealing plate 66 there is provided a transport grab handle 70 by means of which the sealing plate 66 can be manipulated with the aid of remotely-controlled manipulating apparatus. The sealing plate 66 is further provided with holding brackets 78 which extend over a portion of the top face of the terminal block; this ensures that the seal will be removed with the portable unit 48 when the latter is removed from its rest position shown in FIGS. 1 to 3.

When the racks containing the process components are assembled, the rack is connected with conduits brought in from the outside by means of the portable unit 48. The portable unit 48 is brought to the installation location during assembly and removed therefrom during disassembly. This movement of portable unit 48 is facilitated by the transport bracket 72 shown in FIGS. 4 and 5 with which each unit is provided. The transport bracket 72 is welded at its ends to corresponding ones of the terminal blocks 50,52.

Bringing the terminal block 52 to its connecting location on the rack 4 is facilitated with the aid of centering means in the form of three rod-like projections 74 extending upwardly from preselected locations on the periphery of the rack connecting plate 40. On the other hand, the terminal block 50 is centered on the wall connecting plate by means of two brackets 76 of angular section arranged at the two lower corners of the plate 44. The brackets 76 receive and hold the portable unit 48 when it is placed in position. By means of this arrangement, the terminal blocks 50,52 are brought into alignment with the conduit end portions in respective connecting plates to which the blocks have to be connected.

It is understood that the foregoing description is that of the preferred embodiments of the invention and that various changes and modifications may be made thereto without departing from the spirit and scope of the invention as defined in the appended claims.

What is claimed is:

1. In a processing cell such as a large-area cell or the like for reprocessing irradiated nuclear reactor fuel elements, the large-area cell having an interior wall which is penetrated from the outside by the end portions of a plurality of conduits and the cell containing a rack in which process components and connecting conduits for the latter are arranged, a conduit interconnecting arrangement for interconnecting the connecting conduits of the rack with respective ones of the conduit end portions penetrating the interior wall of the cell, the conduit interconnecting arrangement comprising:

two terminal blocks each having a plurality of passages formed therein;

a plurality of conduit segments tightly connecting said blocks with each other so as to communicate with corresponding ones of said passages in each of said blocks;

the plurality of conduits outside of the cell being arranged so as to cause the respective conduit end portions thereof penetrating the cell wall to define a first predetermined pattern;

the free ends of the passages in one of the blocks terminating in a pattern corresponding to said first pattern;

first interface means for joining said free ends of said one block with corresponding ones of the wall conduit end portions;

the connecting conduits of the rack being arranged to cause the respective conduit end portions thereof to define a second predetermined pattern;

the free ends of the passages of the other one of said blocks terminating in a pattern corresponding to said second pattern;

second interface means for joining said free ends of said other block with corresponding ones of the rack conduit end portions;

said two terminal blocks and said conduit segments conjointly defining a portable unit removable from and returnable to a rest position whereat the unit connects the wall conduit end portions with respective ones of the rack conduit end portions;

first centering means for centering said one block with respect to the wall conduit end portions so as to bring the passages of the one block into alignment with corresponding ones of the wall conduit end portions when said unit is placed in said rest position; and, second centering means for centering said other one of said blocks with respect to the rack conduit end portions so as to bring the free ends of the passages of said other block into alignment with corresponding ones of the rack conduit end portions when said unit is placed in said rest position.

2. The conduit interconnecting arrangement of claim 1 comprising:

first securing means for securing said one block tightly against the wall conduit end portions; and, second securing means for securing said other block tightly against the rack conduit end portions.

3. The conduit interconnecting arrangement of claim 2 wherein:

said first interface means comprises: a flat surface formed on said one block at which the free ends of said passages therein terminate; and a wall connecting plate mounted on the wall of the cell and having apertures formed therein for accommodating respective ones of said wall conduit end portions in a close cluster; said apertures being arranged in said first predetermined pattern at the flat surface of the plate facing away from the wall; and, said second interface means comprises: a flat surface formed on said other block at which the free ends of said passages therein terminate; and, a rack connecting plate mounted on the rack and having apertures formed therein for accommodating respective ones of said rack conduit end portions; said apertures of said rack connecting plate being arranged in said second predetermined pattern at the flat surface of the plate facing away from the rack;

said flat surface of said one block and said flat surface of said wall connecting plate being tightly held together by said first securing means when said unit is in its rest position; and, said flat surface of said other block and said flat surface of said rack connecting plate being tightly held together by said second securing means when said unit is in its rest position.

4. The conduit interconnecting arrangement of claim 3 comprising:

first sealing means disposed at the interface of said one block and said wall connecting plate for sealing the respective connecting locations whereat said passages of said one block communicate with said wall conduit end portions; and, second sealing means disposed at the interface of said other block and said rack connecting plate for sealing the respective connecting locations whereat said passages of said other block coommunicate with said rack conduit end portions.

5. The conduit interconnecting arrangement of claim 3 wherein:

the first segments of each of said passages in each of said blocks being arranged so as to be in alignment with said conduit segments;

the remaining segments of each of said passages in each of said blocks being bores extending perpendicularly to said first segments, respectively, and terminating in said respective flat surfaces of said blocks; and, the bores of said one block terminating in said first pattern and the bores of said other block terminating in said second pattern.

6. The conduit interconnecting arrangement of claim 5 wherein: said rack connecting plate is mounted on top of the rack so as to define a plane extending perpendicularly to the plane of said wall connecting plate; said connecting segments being parallel to each other and curved at an angle of ninety degrees whereby said segments interconnect said one block with said other block.

7. The conduit interconnecting arrangement of claim 1 wherein:

said first centering means including a pair of projecting metal guides extending outwardly from the inside wall of the cell at selected locations on the periphery of said wall connecting plate for guiding said one block into aligned engaging contact with said wall connecting plate when said unit is placed in said rest position; and, said second centering means including a set of projecting metal guides extending outwardly from the top of the rack at selected locations on the periphery of said rack connecting plate for guiding said other block into aligned engaging contact with said rack connecting plate when said unit is placed in said rest position.

* * * * *